United States Patent [19]

Nishioka et al.

[11] 4,214,558

[45] Jul. 29, 1980

[54] FUEL CONTROL METHOD AND SYSTEM WITH A CIRCUIT FOR OPERATING VALVE IN EFFECTIVE WORKING RANGE

[75] Inventors: Tetsuji Nishioka, Yokohama; Masaharu Asano; Makoto Anzai, both of Yokosuka; Akio Hosaka, Mori, all of Japan

[73] Assignee: Nissan Motor Company, Limited, Yokohama, Japan

[21] Appl. No.: 836,014

[22] Filed: Sep. 23, 1977

[30] Foreign Application Priority Data

Sep. 24, 1976 [JP] Japan ..... 51-113613

[51] Int. Cl.[2] ..... F02B 3/00

[52] U.S. Cl. ..... 123/489; 123/437

[58] Field of Search ..... 123/32 EE, 32 ED, 32 EF, 123/32 EA, 32 AE, 119 EC; 60/276, 285

[56] References Cited

U.S. PATENT DOCUMENTS

| | | | |
|---|---|---|---|
| 3,998,189 | 12/1976 | Aoki | 123/32 EE |
| 4,019,470 | 4/1977 | Asano | 123/32 EE |
| 4,022,171 | 5/1977 | Laprade | 123/119 EC |
| 4,046,118 | 9/1977 | Aono | 123/32 EE |
| 4,061,117 | 12/1977 | Ikeura | 123/32 EE |
| 4,131,089 | 12/1978 | Fujishiro | 123/119 EC |

*Primary Examiner*—Stuart N. Hecker
*Assistant Examiner*—Alan Faber
*Attorney, Agent, or Firm*—Lowe, King, Price & Becker

[57] ABSTRACT

A fuel control system for an internal combustion engine includes an exhaust gas sensor from which feedback control signal is derived, a limiter for limiting the maximum and minimum voltages of the control signal and a triangular wave generator. The triangular wave has a constant amplitude peak of which the maximum value is slightly greater than the maximum voltage of the control signal and the minimum value is slightly below the minimum voltage of the control signal. A comparator is provided to produce an output at one of two binary levels depending upon whether the control signal is above or below the instantaneous value of the triangular wave. The output from the comparator is a train of pulses whose duty cycle ranges from predetermined minimum to maximum values which correspond respectively to the minimum open and closure times of air-fuel mixing control valves.

7 Claims, 8 Drawing Figures

FUEL CONTROL METHOD AND SYSTEM WITH A CIRCUIT FOR OPERATING VALVE IN EFFECTIVE WORKING RANGE

BACKGROUND OF THE INVENTION

The present invention relates generally to fuel control systems for internal combustion engines, and particularly to such a system using air-fuel mixing control valves operable to open in response to the width of feedback correction pulses derived from a sensed air-fuel ratio within the exhaust system, wherein the width of the pulses is controlled within the effective working range of the control valves. In a closed loop fuel control system for internal combustion engines, the deviation of the air fuel ratio within the exhaust system from a desired value is detected to derive a feedback correction signal which is used to modulate the width of electrical pulses. The electrical pulses are supplied to air-fuel mixing control valves to control the air-fuel ratio. However, the control valve is incapable of responding to rapidly interrupted signals. For example, the conventional air-fuel mixing control valves have a minimum valve opening time of 5 milliseconds and a minimum valve closure time of 2.5 milliseconds. If the feedback control signal varies excessively in amplitude so that the width of the feedback correction pulses becomes smaller than the 5-milliseconds duration or the interval between successive pulses becomes smaller than the 2.5-millisecond duration, the corrective action cannot be faithfully reflected in the controlled air-fuel ratio.

Practically, the electrical control pulses are generated by a comparator which compares the amplitude of the feedback correction analog signal with the instantaneous value of triangular wave pulses and provides an output at one of two discrete voltage levels depending upon the relative magnitude of the input voltages. If the feedback analog signal represents an integration of the deviation of the air-fuel ratio in the exhaust system, the analog signal may build up above the maximum amplitude of the triangular wave so that the output of the comparator remains at one of the discrete voltage levels and control valves remain open (or closed) over time. Therefore, the corrective action on the air-fuel ratio cannot be faithfully effected due to the building-up of the integration as well as to the limited working range of the control valve. Furthermore, the control valves tend to hesitate when the control pulses is reapplied.

SUMMARY OF THE INVENTION

An object of the invention is to provide a fuel control system which operates control valves within an effective working range to overcome prior art disadvantages.

In accordance with the invention, a feedback control signal is derived from an exhaust gas sensor to control the width of electrical pulses to be applied to electromagnetic control valves adapted for controlling the ratio of air to fuel by the width of the applied pulses. For generating the electrical pulses, a triangular wave generator is provided as a source of said pulses and the amplitude of the feedback control signal is limited by a reference setting circuit which sets upper and lower reference levels which are respectively determined in relation to the maximum and minimum amplitudes of the triangular wave. A comparator is provided to compare the amplitude limited feedback control signal with the triangular wave pulses. The output of the comparator is at a high voltage level when the control signal is above the instantaneous value of the triangular wave and at a low voltage level when the situation is reversed. The maximum amplitude of the control signal is set at a value which is 90% of the maximum voltage of the triangular wave and the minimum amplitude of the control signal is set at 20% of the maximum voltage of the triangular wave so that the maximum and minimum values of the analog control signal lie within the maximum and minimum values of the triangular wave. By limiting the analog signal amplitude to within the amplitude of the triangular wave, the analog signal will be caused to vary toward the reference point in response to a change in air-fuel ratio in the exhaust system so that the control loop will have a smaller overshoot than it has when the analog is allowed to build up indefinitely. The rectangular pulses from the comparator have a minimum pulse duration of 5 milliseconds or 20% duty cycle at a pulse repetition frequency of 40 Hz and a maximum pulse duration of 22.5 milliseconds or 90% duty cycle which corresponds to minimum interval of 2.5 milliseconds between successive pulses. This ensures that the control valves are turned on and off even when the analog control signal is at one of two extreme voltage levels. This prevents the hesitation or reluctance of the control valve when it responds to the reapplication control pulses.

BRIEF DESCRIPTION OF THE DRAWINGS

The invention will be further described with reference to the accompanying drawings, in which.

DESCRIPTION OF THE PREFERRED EMBODIMENTS

Figure 1:
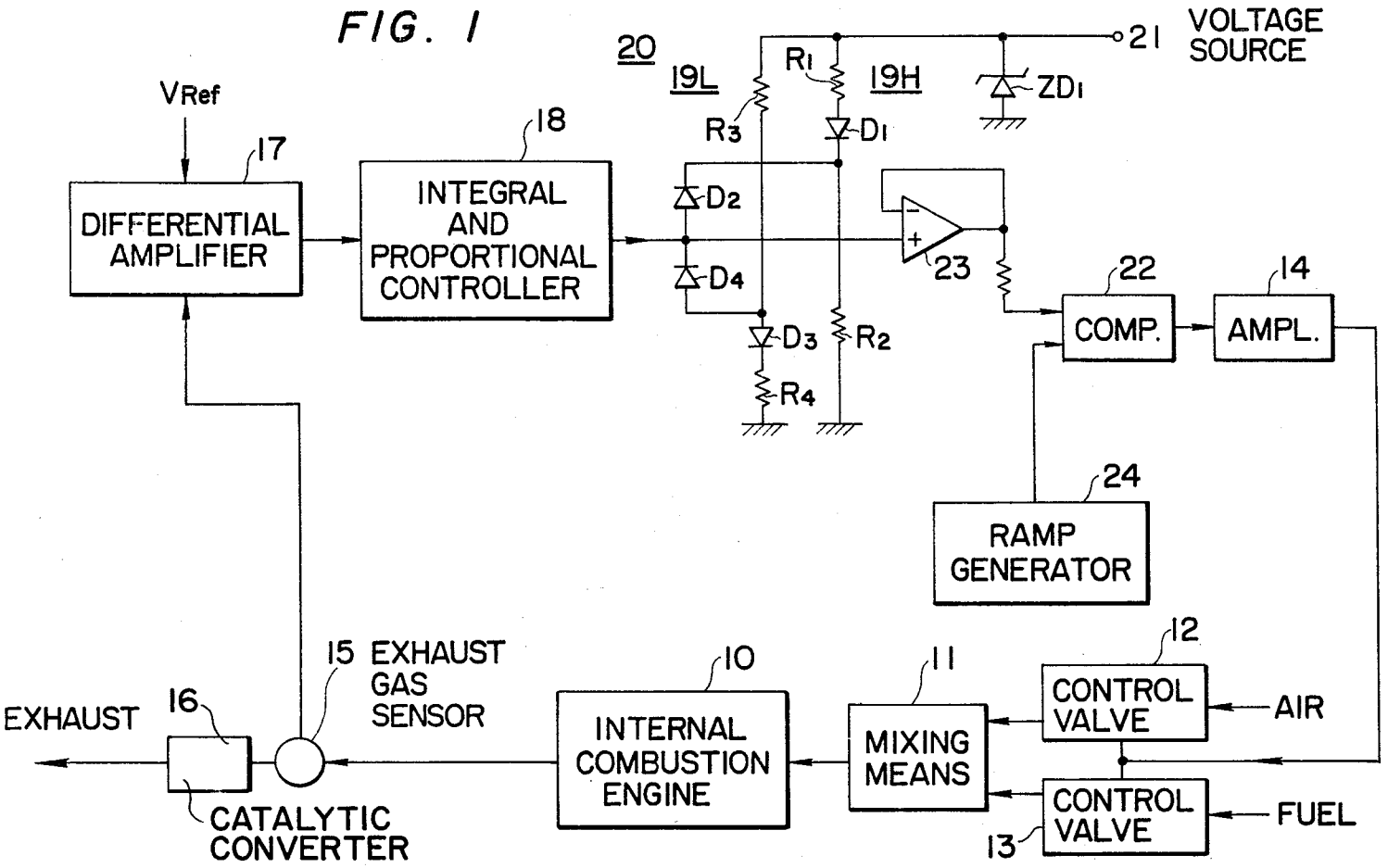
FIG. 1 is a circuit block diagram of an embodiment of the invention.

Referring now to FIG. 1, a fuel control system embodying the invention is illustrated. The internal combustion engine 10 is supplied with a mixture of air and fuel from mixing means 11 which may be a conventional carburetor including electromagnetic control valves 12 and 13 disposed respectively in air and fuel supply passages and responsive to electrical pulses applied thereto from the output of amplifier 14. The amount of air and fuel is proportional to the opening period of the respective control valves. The mixing means 11 is communicated to the intake pipe (not shown) to permit the engine to be operated in response to the opening of throttle control valve.

In the exhaust pipe of the engine is provided an exhaust gas sensor 15 upstream from a three-way catalytic converter 16. The exhaust gas sensor 15 is an oxygen sensor of the zirconia electrolyte type which, when exposed to engine exhaust gases at high temperatures, generates an output voltage which changes appreciably as the air-fuel ratio of the exhaust gases passes through the stoichiometric level. The output voltage of the sensor 15 is a function of air-fuel ratio determined by the mixing means 11 and exhibits a fairly steep slope as the mixture passes through stoichiometry. The catalytic converter 16 is a device of the type in which exhaust gases flowing therethrough are exposed to a catalytic substance which, given the proper air-fuel ratio in the exhaust gases, will promote simultaneous oxidation of carbon monoxide and hydrocarbons and reduction of oxides of nitrogen.

The output from the oxygen sensor 15 is fed into a closed loop mixture control unit 20 to generate a signal which is used to correct the air-fuel ratio to a desired value where the efficiency conversion is at a maximum. As shown in FIG. 1, the control unit includes a differential amplifier 17 which computes the difference between the sensor output and a reference voltage $V_{ref}$, which difference is provided to a controller 18. The controller 18 provides integration of the difference signal or additionally provides proportional modification of the amplitude of the difference signal. If the proportional control is additionally provided, the output from the controller 18 is a sum of the integration and proportioning of the difference signal.

The control unit 20 includes an upper and lower voltage limiter including an upper reference setting circuit 19H and a lower reference setting circuit 19L. The upper reference is set by resistors R1 and R2 connected in series between a voltage source 21 and ground with a diode D1 connected therebetween with its polarity poled to block current toward source 21. A Zener diode $ZD_1$ is connected between the voltage source 21 and ground to maintain the potential across the series-connected resistors R1 and R2 constant regardless of the voltage fluctuation of the source 21. The junction between resistor R1 and diode D1 is set at a voltage $V_{LH}$. However, if the forward voltage drop of diode D1 is negligibly small, the junction between the diode D1 and resistor R2 can be considered as the point of upper setting level $V_{LH}$. The upper voltage limiter further includes a diode D2 connected to the output of the controller 18 to pass current to the upper setting point between D1 and R2 when the output from the controller 18 exceeds the upper setting level $V_{LH}$. The lower reference is set by resistors R3 and R4 connected in series between the voltage source 21 and ground with a diode D3 connected therebetween with its polarity poled to block current from ground to source 21. The junction between resistor R4 and diode D3 is set at a lower voltage $V_{LL}$. However, if the forward voltage drop of diode D3 is negligibly small, the junction between diode D3 and resistor R3 can be considered as the point of lower setting level $V_{LL}$. A diode D4 is connected to the junction between R3 and D3 to pass current therefrom to the output of the controller 18 when the controller output falls below the lower setting level so that the minimum voltage of the controller output is maintained at voltage $V_{LL}$.

Figure 2:
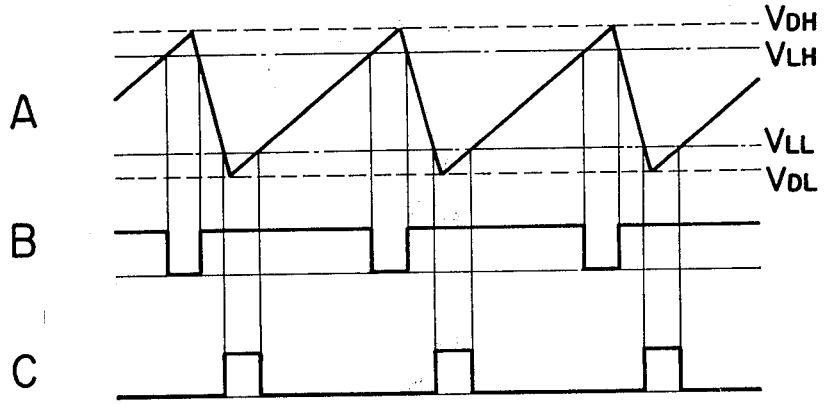
FIG. 2, including A–C is a waveform diagram illustrating the voltage relations between the control signal and the triangular wave pulses and the maximum and minimum durations of the control pulses.
Figure 3:
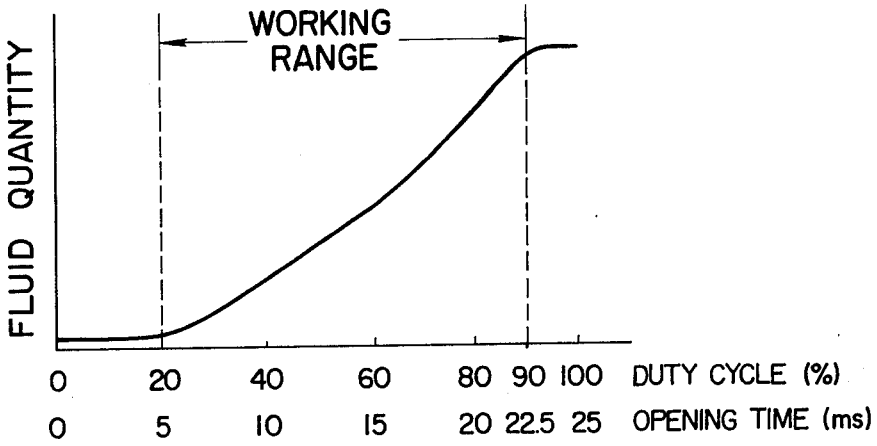
FIG. 3 is a graphic illustration of the working range of an electromagnetic control valve.

The voltage-limited controller output is applied to a first input of a comparator 22 through a buffer amplifier 23 for comparison with a sawtooth or triangular wave voltage supplied from a ramp generator 24. The ramp generator 24 is so designed that its maximum voltage $V_{DH}$ is set at a higher level than the voltage $V_{LH}$ and its minimum voltage $V_{DL}$ is set at a lower level than the voltage $V_{LL}$ as illustrated in FIG. 2A. The comparator 22 provides an output at a high voltage level when the controller output is higher than the triangular wave and at a low voltage level when the situation is reversed. Since the maximum and minimum voltage levels of the controller output are maintained constant, the maximum duty cycle of the comparator output can be limited to 90% as shown in FIG. 2B and the minimum duty cycle can be limited to 20% as shown in FIG. 2C, when the frequency of the ramp generator is 40 Hz. The output from the comparator 22 is a train of rectangular pulses with the duration variable in dependence on the magnitude of the control signal from the controller 18 and the control valves 12 and 13 are supplied with the amplified control pulses to open in response to the duration of the pulse. The minimum opening time of the control valves correspond to the minimum duty cycle of the applied pulse and the maximum opening time or minimum closure time corresponds to the maximum duty cycle so that the control valves are operated in the effective working range of from 5 milliseconds to 22.5 milliseconds of opening time as indicated by the dotted lines in FIG. 3.

Under any circumstances, the control valves 12 and 13 are caused to open and close in response to the applied pulses so that they have no tendency to hesitate when they respond to the reapplication of control pulses from the comparator 22. Since the maximum and minimum levels of the controller output are limited, the control signal will approach the reference point earlier than otherwise so that air-fuel ratio is prevented from drifting far away from stoichiometry with attendant reduction in the amount of noxious exhaust components.

Figure 4:
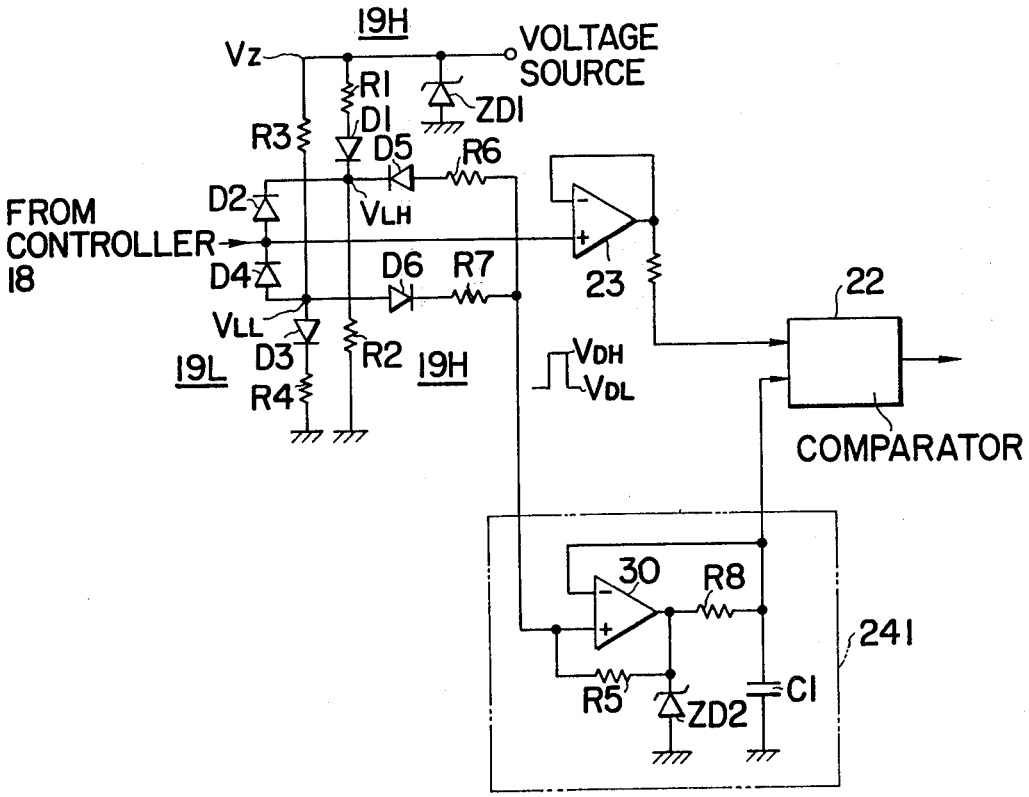
FIG. 4 is a first modification of the embodiment of FIG. 1.

A modification of the previous embodiment is shown in FIG. 4 which is similar to the previous embodiment with the exception that the triangular wave generator 24 is supplied with a voltage determined by the reference setting circuits 19H and 19L such that the voltage relations between $L_{DH}$, $V_{LH}$ and $V_{DL}$, $V_{LL}$ can be automatically interrelated. In FIG. 4 the triangular wave generator 241 comprises an operational amplifier 30 having a noninverting input connected to its output terminal by a resistor R5 and and connected to the upper reference setting point by a circuit including a resistor R6 and a diode D5 poled to conduct current to the junction between diode D1 and resistor R2 and also to the lower reference setting point by a circuit including a resistor R7 and diode D6 poled to conduct current to the non-inverting input of the operational amplifier 30. A Zener diode ZD2 is connected across the output of operational amplifier 30 and ground. It is to be noted that diode ZD2 has the same breakdown voltage as ZD1 so that the output of operational amplifier 30 is maintained at the same potential $V_z$ as the potential across resistors R1 and R2 (as well as resistors R3 and R4). An RC time constant circuit including resistor R8 and capacitor C1 in series is connected between the output of amplifier 30 and ground with the junction between resistor R8 and capacitor C1 being connected to the inverting input of the operational amplifier 30 and also to the comparator 22.

With this arrangement, the voltage $V_{LH}$ and $V_{LL}$ can be given as follows:

$$V_{LH}=(R2V_z+R1V_F)/(R1+R2) \quad (1)$$

$$V_{LL}=(R4\ V_z-R3\ V_F)/(R3+R4) \quad (2)$$

where, $V_F$ is the forward voltage drop across each of the diodes D5 and D6. Since the output of amplifier 30 is held at a voltage $V_z$, the maximum and minimum voltages $V_{DH}$ and $V_{DL}$ of the triangular wave can be interrelated to voltages $V_{LH}$ and $V_{LL}$ by the following equations:

$$V_{DH}=(R6\ V_z+R5\ V_{LH})/(R5+R6) \quad (3)$$

$$V_{DL}=(R5\ V_{LL})/(R5+R7) \quad (4)$$

In operation, assuming that the output of operational amplifier 30 is at high voltage level so that the potential at the noninverting input is at the maximum voltage level $V_{DH}$. The capacitor C1 is charged by the current supplied from the output of operational amplifier 30 through resistor R8 to build up an increasing voltage which is fed back to the inverting input of the amplifier. When the maximum voltage $V_{DH}$ is reached the operational amplifier 30 acting as a comparator switches to the output low voltage state which discharges the capacitor C1 and at the same time switches the voltage level of the noninverting input to the minimum voltage $V_{DL}$. When the decreasing voltage across capacitor C1 reaches the minimum voltage $V_{DL}$, the amplifier 30 then switches to the high voltage state. These process will repeat at a frequency determined by the time constant R8C1 and as a result of train of triangular wave appears across the capacitor C1 and the potential at the noninverting takes one of maximum and minimum voltages $V_{DH}$ and $V_{DL}$ at the same frequency.

Figure 5:
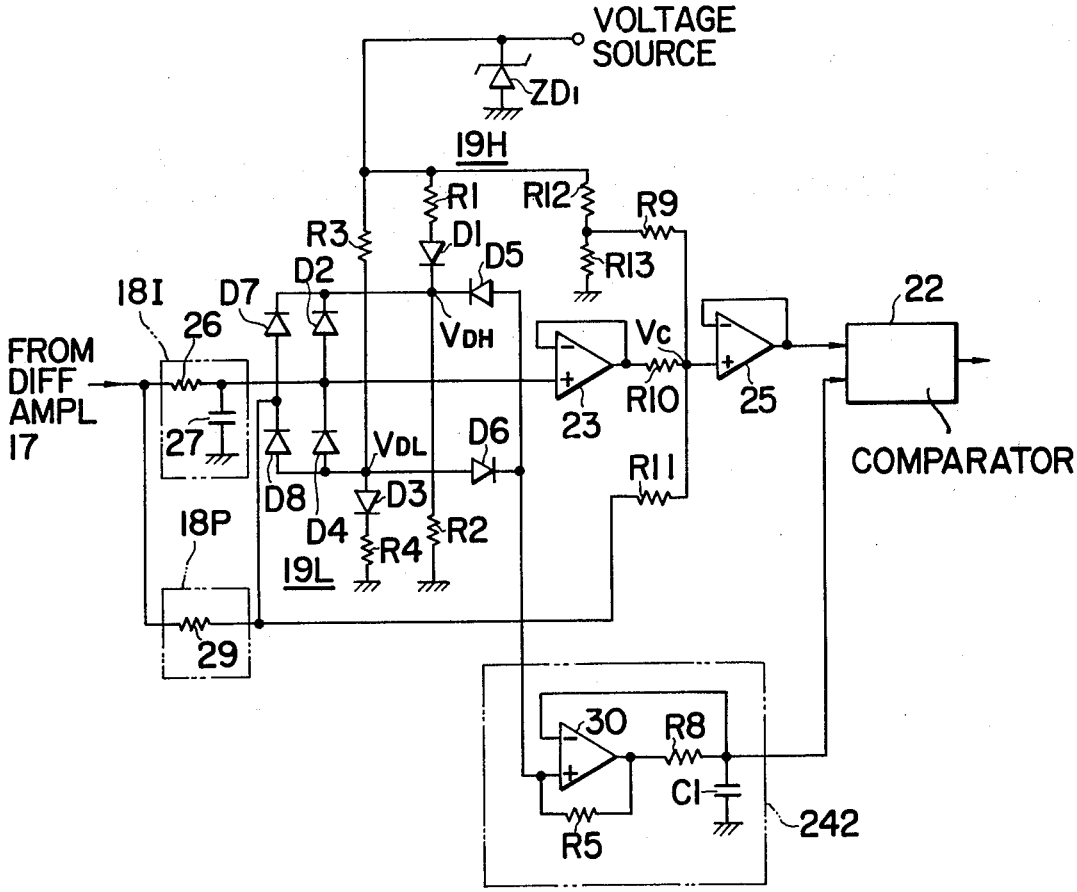
FIG. 5 is an alternative embodiment of the invention.

FIG. 5 illustrates an alternative embodiment of the invention which is similar to the embodiment of FIG. 4 except that voltage limiter sets the maximum and minimum voltages $V_{DH}$ and $V_{DL}$ instead of $V_{LH}$ and $V_{LL}$, and the controller 18 provides separate proportional and integral outputs which are limited to the maximum and minimum voltages $V_{DH}$ and $V_{DL}$ and these outputs are decreased and increased, respectively, in relation to the voltages $V_{DH}$ and $V_{DL}$. In FIG. 5, the integral controller 18I is comprised of a resistor 26 and a capacitor 27 connected in series between the output of differential amplifier 17 and ground with the junction between the them connected to the junction of diodes D2 and D4 as well as to the buffer amplifier 23. The proportional controller 18P comprises a sigle resistor 29. A diode D7 is connected to the output of proportional controller 18P to pass current to the junction between diode D1 and resistor R2 where voltage $V_{DH}$ is set when the proportional signal exceeds the voltage $V_{DH}$ and a diode D8 is connected to the junction between diode D3 and resistor R3 where the minimum voltage $V_{DL}$ is set so that current flows to the output of proportional controller when the proportional signal falls below the minimum voltage $V_{DL}$. Resistors R10 and R11 couple the output from the buffer amplifier 23 and the proportional signal to a common buffer amplifier 25. A circuit including series connected resistors R12 and R13 provides a suitable DC potential through a resistor R9 to the buffer amplifier 25. The resistors R9 to R13 are selected such that the combined integral and proportional signal at the output of buffer amplifier 25 is scaled down and of respectively in relation to the voltages $V_{DH}$ and $V_{DL}$. In the alternative embodiment shown in FIG. 5, the noninverting input of operational amplifier 30 of the triangular wave generator 242 is directly connected to the anode and cathode terminals of diode D5 and D6, respectively, and the Zener diode ZD2 of FIG. 4 has been dispensed with so that the potential at the ampltider's noninverting input is determined simply by the reference setting circuits 19H and 19L.

Figure 6:
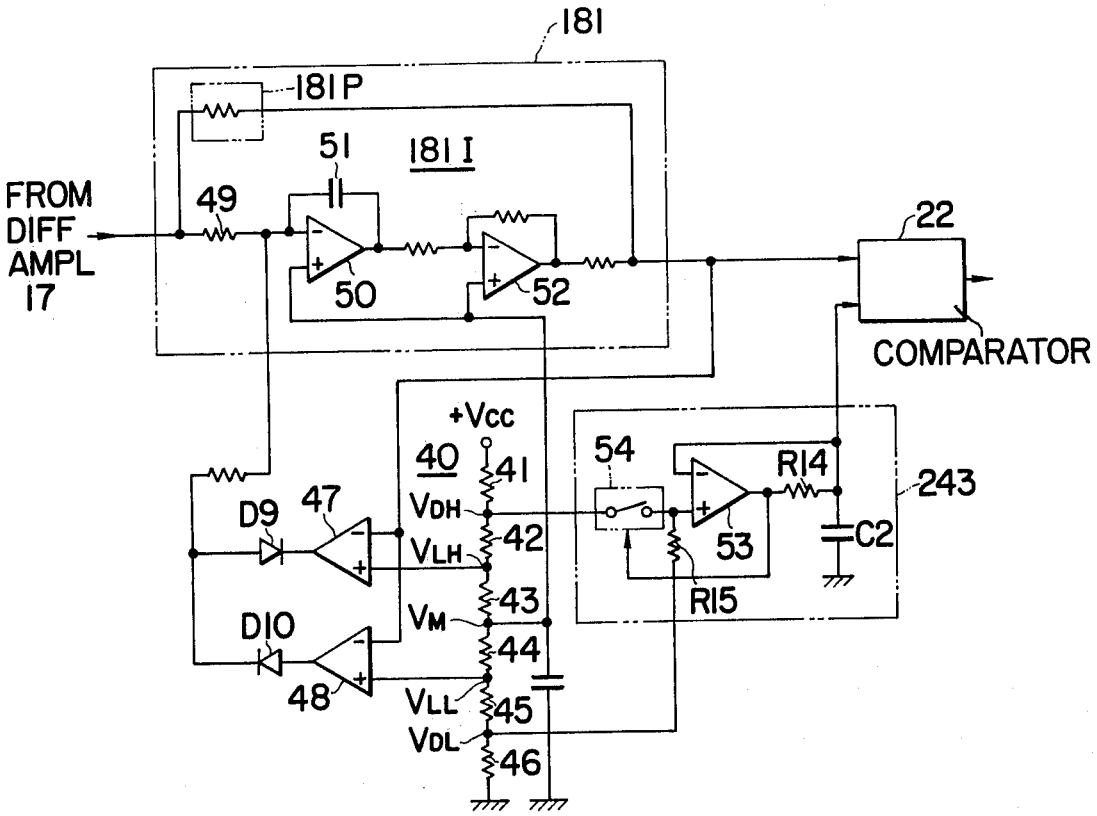
FIG. 6 is a second modification of the embodiment of FIG. 1.

A second modification of the embodiment of FIG. 1 is illustrated in FIG. 6 in which a setting circuit 40 includes a series of resistors 41, 42, 43, 44, 45 and 46 which is connected between a voltage supply Vcc and ground to establish various voltage references including $V_{DH}$, $V_{LH}$, $V_{LL}$ and $V_{DL}$. Comparators 47 and 48 are provided having their inverting inputs connected together to the output of the controller 181. The noninverting input of comparator 47 is connected to the junction between resistors 42 and 43 where voltage $V_{LH}$ is established and the noninverting input of comparator 48 is biased at voltage $V_{LL}$ set at the junction between resistors 44 and 45. The controller 181 includes a proportional controller 181P and an integral controller 181I. The integral controller 181I is comprised of an operational amplifier 50 having its inverting input connected to the output of differential amplifier 17 by an integrating resistor 49 and to its output by means of an integrating capacitor 51. An inverting operational amplifier 52 is provided at the output of integral operational amplifier 50. The noninverting inputs of operational amplifiers 50 and 52 are connected together to an intermediate voltage reference $V_M$ between resistors 43 and 44. Diodes D9 and D10 are connected to the outputs of comparators 47 and 48, respectively. Diode D9 is poled in a sense to pass signals of negative polarity to the inverting input of integral controller 181I and diode D10 is poled in a sense to pass signals of positive polarity to the inverting input of the integral controller.

When the combined integral-proportional signal is above the upper setting level $V_{LH}$, the comparator 47 will provide a negative signal via diode D9 to the inverting input of the operational amplifier 50 to discharge the capacitor 51 until the output of controller 181 reduces below the voltage $V_{LH}$. Similarly, when the combined signal is below the lower setting level $V_{LL}$, the comparator 48 will provide a positive signal that charges capacitor 51 until the controller output rises above $V_{LL}$.

The triangular wave generator 243 includes an operational amplifier 53 having noninverting input connected to the maximum reference level $V_{DH}$ between resistors 41 and 42 by way of an electronic switch 54 and also to the minimum reference level $V_{LL}$ by means of a resistor R15. The electronic switch 54 is controlled by the output from the operational amplifier 53 to close its path so that the noninverting input of amplifier 53 is selectively biased at $V_{DH}$ when the amplifier output is switched to a high voltage level and at $V_{DL}$ when the amplifier output is switched to a low voltage level. An RC time constant circuit including resistor R14 and capacitor C2 is connected between the output of amplifier 53 and ground with the junction between them connected to the inverting input of the amplifier 53. As described above in connection with the previous embodiment, the output of operational amplifier 53 is switched between high and low voltage levels depending upon the time constant value R14C2 and the maximum and minimum voltages of the triangular output are set at the voltages $V_{DH}$ and $V_{DL}$.

Figure 7:
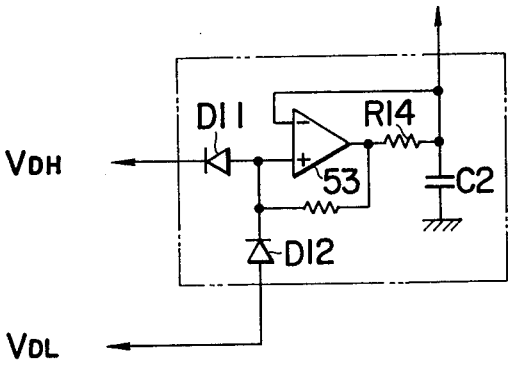
FIG. 7 is a modification of FIG. 6.

Alternatively, the noninverting input of operational amplifier 53 can be selectively biased in an arrangement as shown in FIG. 7 wherein voltages $V_{DH}$ and $V_{DL}$ are coupled to the noninverting input by means of diodes D11 and D12, respectively. The diodes D11 and D12 are selectively rendered conductive in response to the high and low output states of the amplifier 53.

Figure 8:
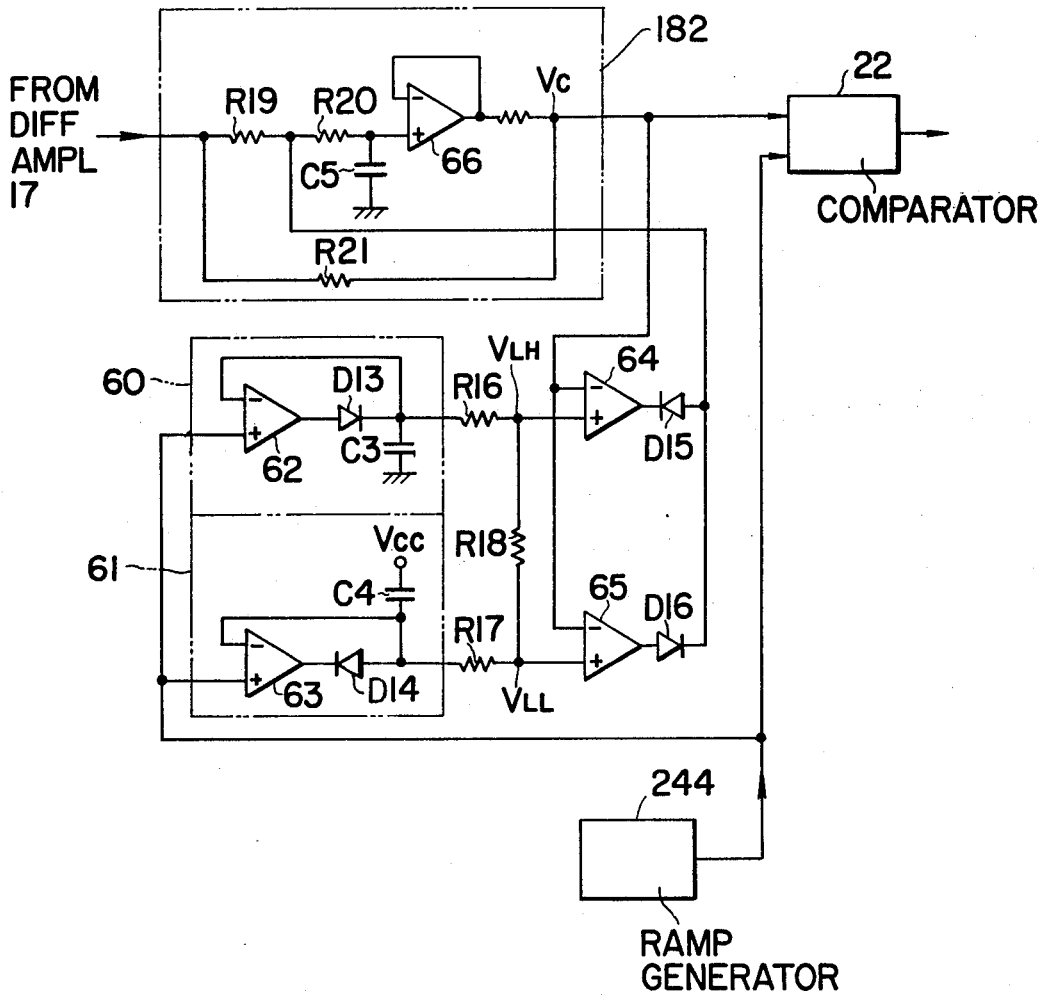
FIG. 8 is a third modification of the embodiment of FIG. 1.

A third modification of the embodiment of FIG. 1 is illustrated in FIG. 8 in which triangular wave (ramp) generator 244 determines its maximum and minimum amplitudes $V_{DH}$ and $V_{DL}$ which are detected by a positive peak detector 60 including an operational amplifier comparator 62 whose output is connected to ground through a circuit including diode D13 and capacitor C3 with the junction between them connected to the inverting input of the amplifier for comparison with the triangular wave supplied to the noninverting input. When the voltage across the capacitor C3 is smaller than the instantaneous value of the triangular wave, the comparator 62 is switched to the high voltage level to charge the capacitor C3 through diode D13. Diode D13 prevents the capacitor C3 from being discharged when the comparator is switched to the low output state so that the voltage across capacitor C3 represents the maximum voltage of the triangular wave.

The negative peak detector 61 includes a comparator 63 whose output is connected to a voltage source Vcc through a circuit including diode D14 and capacitor C4 with the junction between them connected to the inverting input of the comparator for comparison with the triangular wave applied to the noninverting input. When the potential at the inverting input is greater than the instantaneous value of the triangular wave, the comparator 63 is at the low output level and the capacitor C4 is charged through diode D14 until the inverting potential reaches the noninverting potential. Since diode D14 prevents the capacitor C4 from being discharged when the input condition is reversed, the potential at the inverting input presents the minimum voltage level $V_{DL}$. To the outputs of peak detectors 60 and 61 are connected an adjusting network including resistors R16, R17 and R18 to scale down the voltages $V_{DH}$ to $V_{LH}$ and scale up $V_{DL}$ to $V_{LL}$.

Comparators 64 and 65 are provided having their inverting inputs connected together to the output of the controller 182 and their noninverting inputs respectively connected to the junction of resistors R16 and R18 and to the junction of resistors R17 and R18. The controller 182 includes a series-connected integrating resistors R19 and R20 and an integrating capacitor C5 connected between the output of differential amplifier 17 and ground with the junction of capacitor C5 and resistor R20 being connected to the input of a buffer amplifier 66. A proportional control resistor R21 is connected at one end to the output of differential amplifier 17 and at the other end to the output of controller 182. The junction between resistors R19 and R20 is connected to the outputs of comparators 64 and 65 by diodes D15 and D16, respectively.

With these arrangements, the output of controller 182 is compared with the voltages $V_{LH}$ and $V_{LL}$ and when the output is higher than $V_{LH}$ the diode D15 is rendered conductive to discharge the integrating capacitor C5. On the other hand, when the output falls below $V_{LL}$ diode D16 will be rendered conductive to charge the integrating capacitor C5. Therefore, the maximum and minimum voltages of the output from controller 182 are maintained at voltages $V_{LH}$ and $V_{LL}$, respectively, in relation to the the amplitude of the triangular pulses.

What is claimed is:

1. In a fuel control system for an internal combustion engine of a type having air-fuel mixing means including electromagnetic control valve means effective to open and close in response to electrical pulses applied thereto, said pulses requiring durations and separations corresponding respectively to a minimum effective opening period and a minimum effective closure period of said valve means, and exhaust means including a catalytic converter effective when supplied with exhaust gases containing air and fuel in a certain ratio to accelerate simultaneously the oxidation of unburned fuel and the reduction of nitrogen oxides, comprising:

means for generating a first signal indicative of the concentration of a predetermined constituent of the gases in said exhaust means;

means for generating a second signal representative of the deviation of said first signal from a predetermined value representing a desired air-fuel ratio; and means responsive to said second signal for generating control pulses for operating said air-fuel mixing control valve means;

wherein there is a tendency for hesitation and resultant time lag in control valve operation to occur caused by application thereto of control pulses having variable durations and separations that extend below said minimum required periods of said required pulses, a system for reducing the hesitation and time lag, comprising:

means for generating periodically occurring electrical waveforms with a magnitude varying as a function of time between first and second constant levels;

means for limiting the magnitude of said second signal to a first value lower than said first constant level of said periodic waveforms corresponding to one of said minimum open and closure periods of said valve means and for limiting the magnitude of said second signal to a second value higher than said second constant level of said periodic waveforms corresponding to the other one of said minimum open and closure periods of said valve means; and means for comparing the magnitude of said periodic waveforms with the magnitude of an output signal from said limiting means to generate a binary, valve operating signal depending on the magnitude of said periodic waveforms relative to the magnitude of said output signal from said limiting means, the operating signal thereby having a minimum duration no larger than a value corresponding to the minimum open period of said valve means and a minimum interval between successive ones of said operating signal no larger than a value corresponding to said minimum closure period of said valve means.

2. A fuel control system as claimed in claim 1, wherein said waveform generating means comprises means for generating triangular waves.

3. A fuel control system as claimed in claim 2, wherein said triangular waves generating means comprises an operational amplifier having first and second input terminals and an output terminal, an RC time constant circuit connected between said output terminal and a ground, a first resistor connected between said first input terminal and said output terminal, said second input terminal connected to said output terminal through the resistor of said RC time constant circuit, and wherein said limiting means comprises means for setting a high reference potential corresponding to said first value and a low reference potential corresponding to said second value, first polarity sensitive means connected to the output of said second signal generating means and operable to pass current to said high potential reference setting means, second polarity sensitive means connected to said low potential reference setting means and operable to pass current to the output of said second signal generating means, third polarity sensitive means connected to the first input terminal of said operational amplifier and operable to pass current of said first polarity to said high potential reference setting means through a second resistor, and fourth polarity sensitive means connected to the low potential reference setting means and operable to pass current to said first terminal of said operational amplifier through a third resistor.

4. A fuel control system as claimed in claim 2, wherein said second signal generating means includes an integral controller and a proportional controller having their inputs connected together, and wherein said triangular waves generating means comprises an operational amplifier having first and second input terminals and an output terminal, an RC time constant circuit connected between the output terminal and ground, a first resistor connected between said first input terminal and said output terminal, said second input terminal connected to said output terminal through the resistor of said RC time constant circuit, and wherein said limiting means comprises means for setting a high reference potential corresponding to the maximum magnitude of triangular waves generated by said triangular waves generating means and a low reference potential corresponding to the minimum magnitude of said triangular waves, first polarity sensitive means connected to the output of said integral controller and operable to pass current to said high potential reference setting means, second polarity sensitive means connected to said low potential reference setting means and operable to pass current to the output of said integral controller, third polarity sensitive means connected to the output of said proportional controller and operable to pass current to said high potential reference setting means, fourth polarity sensitive means connected to the low potential reference setting means and operable to pass current to the output of said proportional controller, fifth polarity sensitive means connected to the first input terminal of said operational amplifier and operable to pass current to said high potential reference setting means, sixth polarity sensitive means connected to said low potential reference setting means and operable to pass current to the first input terminal of said operational amplifier, and a resistance network connected to the outputs of said integral and proportional controllers for modifying the magnitude of the outputs from said integral and proportional controllers.

5. A fuel control system as claimed in claim 2, wherein said triangular waves generating means comprises means for setting first, second, third and fourth reference potentials in the order of increasing potential, a first comparator having a first input selectively connected to respond to one of said first and fourth reference potentials in response to the output thereof and an RC time constant circuit connected between the output of said first comparator and ground with the junction between the resistor and capacitor of the RC circuit being connected to a second input of said first comparator, and wherein said limiting means comprises second and third comparators each having first and second input terminals and an output terminal, the first input terminals of said second and third comparators being connected together to the output of said second signal generating means, the second input terminal of the second comparator being connected to said second reference potential and the second input terminal of the third comparator being connected to said third reference potential, first polarity sensitive means connected to the output of the second comparator and operable to pass current to the output of said second comparator, and second polarity sensitive means connected to the output of the third comparator and operable to pass current to the input of said second signal generating means.

6. A fuel control system as claimed in claim 2, wherein said limiting means comprises a first peak detector for detecting the maximum magnitude of triangular waves generated by said triangular waves generating means and a second peak detector for detecting the minimum magnitude of said triangular waves, a resistance network connected to the outputs of said first and second peak detectors for generating a first and a second potential corresponding respectively to said first and second values, a first and a second comparator each having first and second input terminals of said first and second comparators being connected together to the output of said second signal generating means, the second input terminal of the first comparator being connected to said first potential and the second input terminal of said second comparator being connected to said second potential, first polarity sensitive means connected to the output terminal of said first comparator and operable to pass current to the output of said first comparator and second polarity sensitive means connected to the output terminal of said second comparator and operable to pass current to the input of said second signal generating means.

7. A method of reducing hesitation in the operation of a fuel control system for an internal combustion engine of a type having air-fuel mixing means including electromagnetic valve means effective to open and close in response to electrical pulses applied thereto, wherein the pulses require at least minimum durations and separations corresponding respectively to effective opening and closure periods of said valve means, and exhaust means including a catalytic converter effective when supplied with exhaust gases containing air and fuel in a certain ratio to accelerate simultaneously the oxygen of unburned fuel and the reduction of nitrogen oxides, the system comprising means for generating a first signal indicative of the concentration of a predetermined constituent of the gases in the exhaust means; means for generating a second signal representative of the deviation of the first signal from a predetermined value representing a desired air-fuel ratio; and means responsive to the second signal for generating control pulses for operating the air-fuel mixing control valve means, wherein hesitation in response to the fuel control system occurs as a result of a tendency of the electromagnetic control valve means to have a delayed response to durations of the control pulses less than the minimum opening period of the valve and intervals between successive durations of the control pulses less than the minimum closure period of the valve means, the method comprising the steps of:

generating periodically occurring electrical waveforms having a magnitude varying as a function of time between first and second constant levels;

limiting the magnitude of the second signal to a first value lower than the first constant level of the periodic waveforms corresponding to one of the minimum open and closure periods of said valve means and for limiting the magnitude of the second signal to a second value higher than the second constant level of the periodic waveforms corresponding to the other one of said minimum open and closure periods of said valve means;

comparing the magnitude of the periodic waveforms with the magnitude of the limited second signal;

generating, in response to the comparing step, binary, valve operating signals having a minimum duration no larger than a value corresponding to the minimum open period of the valve means and minimum intervals between successive ones of the operating signal no larger than a value corresponding to the minimum closure period of the valve means; and applying the operating signal to control the valve means.

* * * * *